United States Patent [19]

Bechem et al.

[11] Patent Number: 4,762,602

[45] Date of Patent: Aug. 9, 1988

[54] METHOD AND APPARATUS FOR PROCESSING METAL STRIP IN VERTICAL ELECTROPLATING CELLS

[75] Inventors: Werner Bechem, Hilchenbach; Johann J. May, Iserlohn; Hubertus Peters, Dortmund; Roland Schnettler, Schwerter Strasse; Werner Solbach, Wallmenroth; Dietrich Wolfhard, Dortmund, all of Fed. Rep. of Germany

[73] Assignee: Hoesch Stahl Aktiengesellschaft, Fed. Rep. of Germany

[21] Appl. No.: 945,780

[22] Filed: Dec. 23, 1986

Related U.S. Application Data

[63] Continuation-in-part of Ser. No. 842,534, Mar. 21, 1986, abandoned.

[30] Foreign Application Priority Data

Mar. 23, 1985 [DE] Fed. Rep. of Germany ..... 3510592

[51] Int. Cl.[4] ..... C25D 17/00

[52] U.S. Cl. ..... 204/206

[58] Field of Search ..... 204/206

[56] References Cited

U.S. PATENT DOCUMENTS

| | | | |
|---|---|---|---|
| 4,601,794 | 7/1986 | Tsuda | 204/206 |
| 4,634,504 | 1/1987 | Bechem | 204/206 |
| 4,640,757 | 2/1987 | Podrini | 204/206 |
| 4,655,894 | 4/1987 | Podrini | 204/206 |

*Primary Examiner*—T. M. Tufariello

[57] ABSTRACT

The invention relates to a vertical electroplating cell for processing metal strips in which the strip to be processed running from an upper conductor roll is led to a lower deflecting immersion roll and from there to a further upper conductor roll, the respective descending and ascending strip portion to be processed being subjected in a canal between vertically disposed anodes to the electrolyte flow conducted in circulation at high speed against strip running direction. In such a electroplating cell the circulation of large electrolyte amounts using the minimum possible pump energy is achieved in that the electrolyte flow directed in each case in the canals (6, 7) between the anode rows (5, 7) against the strip running direction are generated via liquid jet pumps disposed on outer canals between rear sides of anode rows and housing walls.

6 Claims, 3 Drawing Sheets

METHOD AND APPARATUS FOR PROCESSING METAL STRIP IN VERTICAL ELECTROPLATING CELLS

This is a continuation-in-part of co-pending application Ser. No. 842,534 filed on Mar. 21, 1986 now abandoned.

BACKGROUND OF THE INVENTION

Metal strips with metallic coatings have attained great importance in many areas of technology. As composite materials they offer the possibility of combining the special properties of the basic material, such as for example strength or magnetic properties, with special properties of the coating material such as for example corrosion resistance or decorative appearance. Electrolytic metal deposition represents a possibility for manufacturing metallic coatings with small thickness tolerances, high surface quality and without the influence of the technological properties of the base material. Examples of such electrolytically plated metal strips are thin steel sheet with an electrolytically deposited lead-tin alloy such as used for fuel containers or a thin steel sheet electrolytically zinc plated or zinc alloy plated for corrosion protection for vehicle bodies as well as electrolytically zinc plated thin steel sheet for manufacturing containers and sheet metal packages.

The largest economic importance resides in the electrolytic zinc plating or zinc alloy plating of thin sheet material for rust protection in the automobile industry. Whereas steel sheet plated with pure zinc is to a large extent cathodically protected by the zinc coating, zinc alloy plated steel sheet exhibits a larger barrier protection effect with respect to attacking corrosive media. The provision of one or the other of the two named zinc coating types is dependent on the weight that the individual automobile manufacturer places on the kinds of corrosion protection.

In earlier times, in the case of electrolytic zinc plating of strips there appeared a trend to installations with vertical movement of the strip in the electrolysis area (vertical cell apparatus). However, worldwide there are also many installations in operation for electrolytic metal deposition on metal strips in which the electrolysis area is arranged horizontally (horizontal cell apparatus), or the electrolytic processing of the metal strip takes place on one side, which strip is deflected by an immersion roll which roll if it is made with a metallic outer surface can also serve as the cathode contact means for the metal strip to be plated (radial cell apparatus).

Strip processing apparatus using the radial cell principle require a double number of cells if the steel band is to be plated with zinc on both sides, which along with technical problems relating to the apparatus also brings with it accompanying large burdens from the investment side. Horizontal cell apparatus have disadvantages in the electrolysis area in that particles from the electrolyte can become deposited on the upper side of the strip, which particles become embedded in the upper coat, and in that on the underside of the strip oxygen collects in the case of less than 100% cathodic efficiency and hydrogen collects in the case of use of insoluble anodes, the gas collecting in the form of bubbles or blisters, which bubbles or blisters can come to disturb the deposition process. In the case of vertical cell apparatus particles engaging the outer surface of the strip are washed from the side of the ascending strip portion by the surge of the electrolyte flowing downwardly along the strip; the metal deposition can take place in one electrolysis cell either on one side, on two sides, or with different coating thicknesses, without the need for large conversion measures. Preferrably soluble anodes are employed, but insoluble anodes can also be used. Edge masks can be used. The process as well as the strip can be visually controlled in each of the employed electrolysis cells and the length of the apparatus is shorter than it is in the case of using either of the other two types of cell construction.

In the case of vertical cell apparatus, in the first generation a very simple construction was employed in which the anodes were arranged to hang freely on both sides of the descending and ascending runs of the strip, the electrolyte was delivered at a low flow rate into the lower region of the electrolysis cell and was discharged in the upper region over an overflow so that in the electrolysis cell electrolyte flow of a speed relevant to the electrolysis process existed. In the case of vertical cell apparatus of the second generation, in the apparatus, which includes immersion rolls, the lower region of the electrolysis cell is separated from the upper region which contains the anodes and therewith the electrolysis path containing cell areas, and the upper and lower regions are connected only through two slot shaped openings which in their short dimension correspond to the spacing between the anodes and in their long dimension correspond to the maximum anode width, through the middle of which slots the steel band to be finished is guided.

Associated with these openings are flow canals in the upper cell portion both for the descending as well as for the ascending strip portion, which canals are formed in the anodes or in plates arranged on the rear sides of the anodes and which in reference to the direction of movement of the strip are formed in the lateral container forming walls of the electrolysis cell. The electrolyte is delivered to the lower cell portion and flows through, in a laminar flow condition, flow compartments arranged in the upper cell portion, and is finally returned over an overflow into a collection container, from which a pump pumps the electrolyte back to the electrolysis cell. In this kind of apparatus the guiding of the flow is such as to produce at the descending strip portion a counterflow opposite to the direction of strip moment and at the ascending strip portion a flow in the same direction as the strip movement, whereby in the case of zinc plating a current density of 60 $A/dm^2$ can be employed without producing a dendritic deposition of zinc.

If however, in the case of electrolytic zinc plating with high current densities, such as for example 100 $A/dm^2$, zinc coatings with optimal zinc crystal structure are to be manufactured or zinc alloy coatings with similar formation of the alloy are to be made, vertical cells with large flow velocity of the electrolyte and similar flow rates at both rows of the strip are used. Since in comparison with one another the electrolysis conditions are more favorable in the electrolyte stream which moves counter to the strip direction then they are in the stream which runs with the strip direction, the problem arises of turning around in comparison to previously used cells the flow direction in the flow compartment with the ascending band portion and of raising the flow velocity of the electrolyte in both flow channels so that a turbulent flow condition exists.

Such a counterflow cell is known from UK patent application GB No. 2,147,009A. The electrolysis cell described in this application is further characterized by the exclusive use of insoluble anodes, by the circulation of the entire electrolyte mass flowing in the flow channels by means of external pumps and by the guiding of the pumped electrolyte mass through jet tubes arranged perpendicular to the strip movement direction, which jet tubes are located on both sides of the strip at the inflow side of the flow channels.

Along with the grounds mentioned in the UK application for the choice of insoluble anodes there are however also many disadvantages for this type of anode which can be avoided through the choice of soluble anodes.

In the case of zinc plating with the use of insoluble anodes a separate dissolving circuit for the follow up of the zinc ions in the electrolyte is necessary, as a result of larger anode polarization there exists a higher voltage loss between anode and cathode, and a large amount of oxygen is developed at the insoluble anodes which fills a portion of the space between the anode and cathodes and so leads to a further increase in the electrolysis voltage and unfavorably influences the coating quality. Further, the most expensive insoluble anodes are of only limited strength and are easily destroyed if as a result of engagement with the steel strip electrically connected to the cathode a short circuit arises, which in the case of the use soluble anodes produces no cost with regard to anodes. If as in the UK application the insoluble anodes are manufactured from lead alloys a small amount of lead is deposited with the zinc and leads after heat treatment of the plated steel sheet to loosening of the coating if in the electrolysis cycle expensive handling of the electrolyte is not provided in order to remove lead gone into solution at the anode site. If lead oxide particles exist at the insoluble anodes due to blowing off of the oxide cover this can negatively influence the coating quality. Further the large amount of oxygen existing because of the strived for high current density has as a result that aerosols are delivered from the electrolysis cell and make necessary an especially extensive exhaust system. The use of soluble anodes in strip form allows the width of the anodes to be easily suited to the width of the strip which leads to a favorable coating distribution on the steel band. Such soluble anodes are used in high production zinc plating apparatus with the help of mechanized handling devices in the electrolysis cells and they are withdrawn in worn out condition. Accordingly, down time for the apparatus is relatively small as is the need for personnel.

In alloy zinc plating with soluble anodes basket anodes have come into use, in which case the anode space is so separated from the cathode by a diaphragm that particles of the anode material which originate in the basket cannot succeed in reaching the metal strip to be processed. Since in modern band processing plants a large number of electrolysis cells are used the number of anode baskets filled with one of the alloying elements of the coating can be so chosen that the ionic relationship of the electrolyte can be held constant by the addition of only a small amount of salt, in which case it is advantageous to use for the correction a salt of the alloying element which together with the zinc is to deposited as the alloyed coating.

Just as in the case of pure zinc plating, in the case of alloy zinc plating with soluble anodes all customary types of electrolytes, such as for example choloride electrolyte, can be used which in general exhibit a higher electrolytic conducting ability than sulfate electrolyte, which in the case of using insoluble anodes has come to be used exclusively.

In the case of electrolytic deposition of tin and of lead-tin alloys the use of insoluble oxygen anodes leads to a rapid formation of tetravalent tin and therewith a large loss of tin through tin matte formation. Moreover, the customarily used fluoroborate electrolyte can not be used together with insoluble anodes.

The circulation of the entire flow mass through external pumps demands large tube cross sections for the electrolyte delivery into the electrolysis cells, which in general can be suited only in complicated ways to the cell geometry determined by the diameters of the reversing rolls and by the anode length.

The arrangement of the delivery tubes provided with jets above the flow compartment with the ascending band portion leads to a large stretch between the current roll and the electrolysis region, whereby an unnecessarily large voltage loss arises in the material strip to be finished. The consumed energy for the circulatory pumping of the entire electrolyte flow mass through external pumps and through, for example, heat exchangers, filters and pump reservoirs is extraordinarily high, since moreover large distances and high differences due to constructional limitations have to be overcome.

It is further very difficult to conduct a fluid stream created by a pump and delivered through a tube at right angles around a symmetrical surface while at the same time creating a very wide stream. The difficulty at arriving at a solution finds expression in the UK patent application which proposes the most different constructions for the formation of the jet tubes.

SUMMARY OF THE INVENTION

It is therefore the object of the present invention to develop a counterflow cell of the vertical cell type with improved properties. The improvements include above all the usability of soluble anodes, a lowering of the energy required for creating the electrolyte flow and a method for creating electrolyte flows which exhibits a uniform velocity over the entire width of the strip to be handled in the depostion region between the anodes.

With the present invention this high and uniform flow rate can be achieved with the minimum possible energy requirement in that a large amount of electrolyte is independently circulated in the cell. With the apparatus according to the invention the circulation of large amounts of electrolyte using a minimum pump energy is achieved in that the liquid jet injector principle is used. This makes it possible for an amount of electrolyte 3 to 5 times the amount of electrolyte introduced by direct pumping to flow in circulation. This increase in the amount in circulation is due to the constructional form of the liquid jet pump in the actual electroplating cell.

To ensure that when using soluble anodes the upper liquid level remains free for observation of the strip and the anode rows, one row of liquid jet pumps for each strip surface is installed in the case of the ascending strip in the lower region of the cell behind the anodes and generate an upwardly directed flow which by the suitable formation of the housing and the upper anode end is deflected and guided through the canal between the anode rows and the strip in such a manner that a downwardly directed flow is formed.

This downwardly directed flow is set in operation in that, due to the liquid jet injector pumps in the lower cell portion behind the anodes, a partial vacuum builds up at the lower end of the canal with ascending strip. By this system a considerable portion of the electrolyte flow amount is conducted in the circulation.

The electroplating cell is supplied with purified and cooled electrolyte in that the necessary electrolyte amount is supplied to the jet nozzles of the liquid jet pumps by a circulation means comprising filter and cooler via a pump.

In the region of the descending strip run the liquid jet pumps are also installed in the lower region of the cell behind the anodes and there they generate a downwardly directed electrolyte flow through mixing tubes and diffusors. The diffusors deflect the electrolyte flow about 180 degrees in the upwardly direction into the canal between the anodes and the strip. The upwardly flowing electrolyte emerges through correspondingly formed anode ends from the region between andoes and strip and can partially flow off to a supply tank, whereas the main flow is conducted by the deflecting topsides of housing walls to the mixing tubes of liquid jet pumps.

BRIEF DESCRIPTION OF THE DRAWINGS

The invention will be explained hereinafter with the aid of an example of embodiment illustrated in the drawings, wherein.

DETAILED DESCRIPTION OF THE PREFERRED EMBODIMENTS

Figure 1:
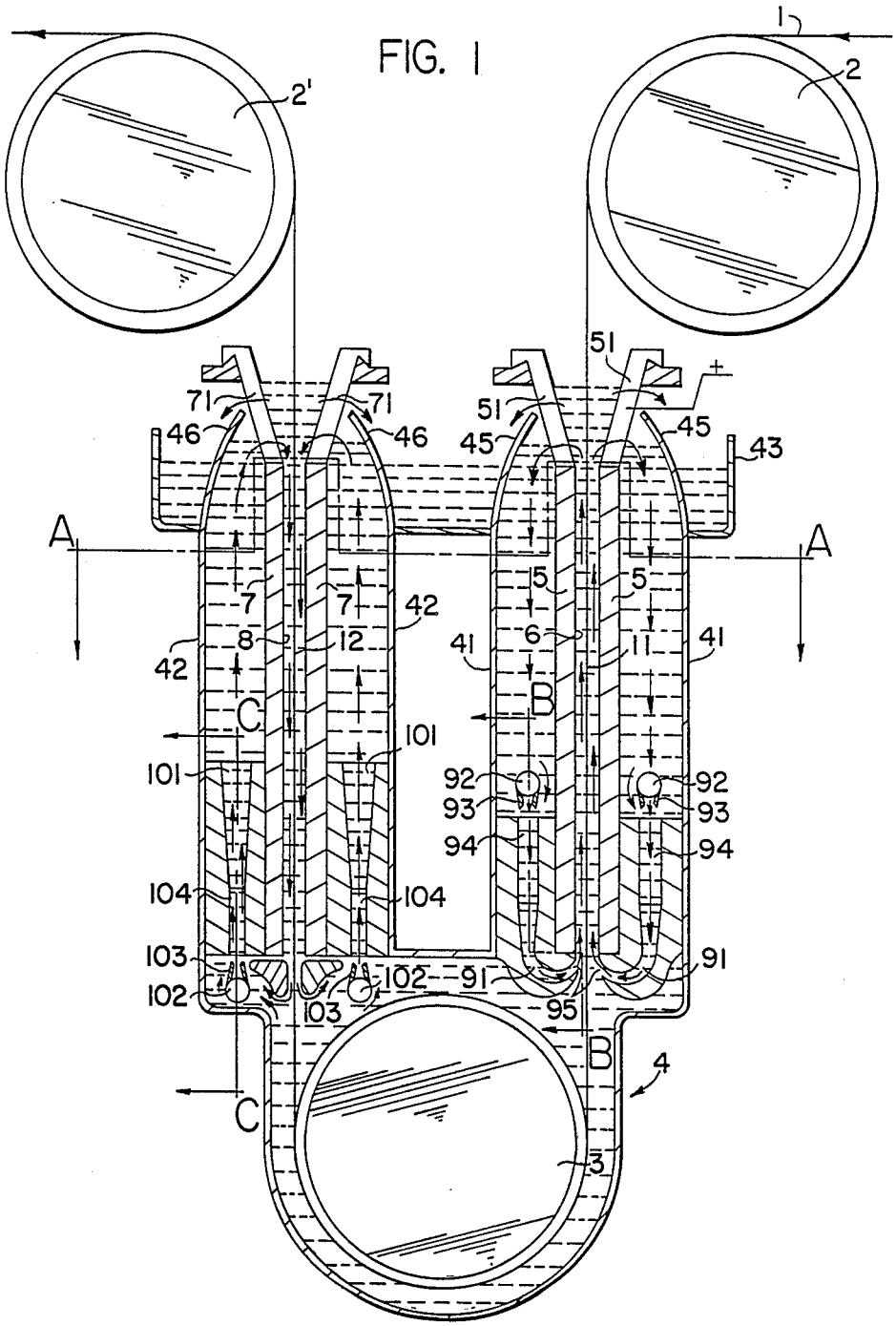
FIG. 1 is a side-elevational section showing a vertical type electroplating cell for continuous processing metal strips according to the invention.

The immersion type vertical plating cell used in the present invention is illustrated in a side cross-sectional view in FIG. 1 and is usually part of a system in which several such electroplating cells are disposed in series. The metal strip (1) to be processed continuously runs from the upper conductor roll (2) with its descending strip portion (11) in the canal (6) between two rows of vertically disposed soluble anodes (5) centrally through to an immersion roll (3) which is disposed in the electroplating cell housing (4) filled with electrolyte. From this deflecting immersion roll (3) the strip is led with its ascending strip portion (12) again between two rows of vertically disposed soluble anodes (7) centrally through the canal (8) to a further upper conductor roll ($2^1$). The gap between the strip portions and the surface of the anode rows will be 10 to 50 mm.

The soluble anodes (5 and 7) are arranged with their surface facing the strip parallel to the plane of the passing strip and removably suspended with the upper anode ends (51 and 71).

Formed round the both rows of anodes (5) are the housing walls (41) with here housing top side (45). In each of the two spaces between the housing walls (41) and the rearsides of the rows of anodes (5) one supply tube (92) and one row of liquid jet pumps are disposed each consisting of one round jet nozzle (93), one round mixing tube (94) and one 180 degrees deflected diffusor (91) with flat-slit-orifice (95).

Formed round the both rows of anodes (7) are the housing walls (42) with here housing top sides (46). In each of the two spaces between the housing walls (42) and the rearsides of the rows of anodes (7) one supply tube (102) and one row of liquid jet pumps are disposed each consisting of one round jet nozzle (103), one round mixing tube (104) and one round diffusor.

Figure 2:
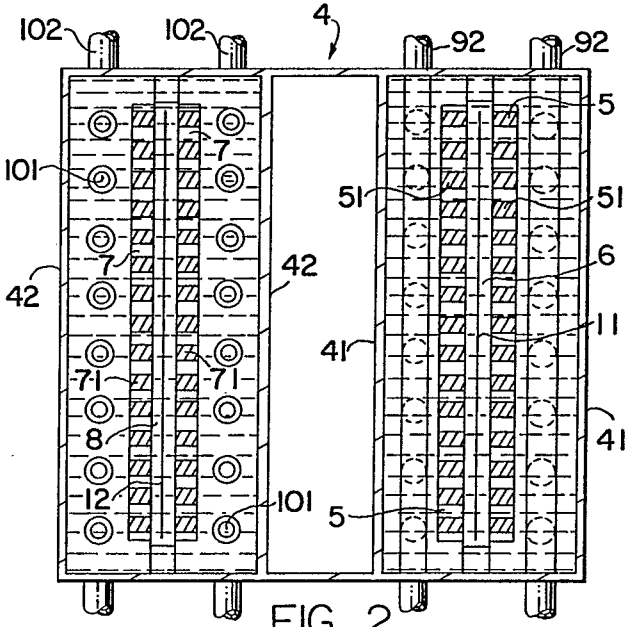
FIG. 2 is a section along the line A—A of FIG. 1.

FIG. 2 is a horizontal section along the line A—A of FIG. 1 showing on the right side the part of the electroplating cell housing (4) with the descending strip portion (11) dividing the canal (6) and on the left the ascending strip portion (12) dividing the canal (8), and at both sides of the two strip portions (11 and 12) is to be seen the section each through one row of fifteen anode ends (51 and 71) with spaces between the anode ends, where the top view of fifteen anodes is to be seen. The number of 15 anodes is an example. The number of anodes depends on the width of the cell or on the width of the strip to be processed.

The housing walls (41) enclose the descending strip portion (11) and the housing walls (42) enclose the ascending strip portion (12). The two supply tubes (92) are arranged in the spaces between the rearsides of the two rows of anodes (5) and the housing walls (41) and there connections reach to the outside of the electroplating cell housing (4). On the right side the connections of the supply tubes (102) for the injector pumps of the ascending strip portion are to be seen. In the spaces between the housing walls (42) and the rows of anodes (7) is to be seen the top view to the orifices of the diffusors (101).

Figure 3:
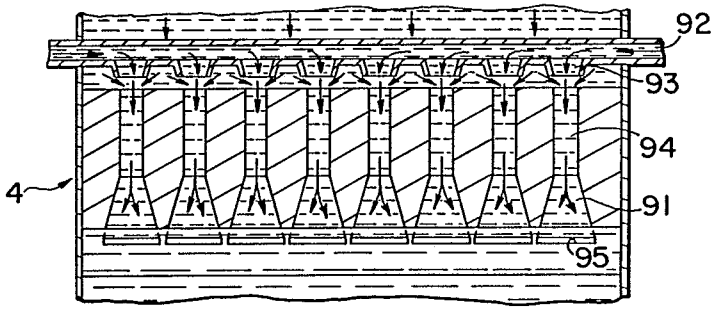
FIG. 3 is a section along the line B—B of FIG. 1, showing a row of liquid jet pumps for the descending strip portion.

FIG. 3 is a vertical section along the line B—B of FIG. 1 showing one of the supply tubes (92) for electrolyte beginning at the connection to the circulation system outside the electroplating cell housing (4) with a row of eight round jet nozzles (93), a row of eight cylindrical mixing tubes (94), a row of eight diffusors (91) with round connection to the mixing tubes and flat-slit-ofifices (95).

Figure 4:
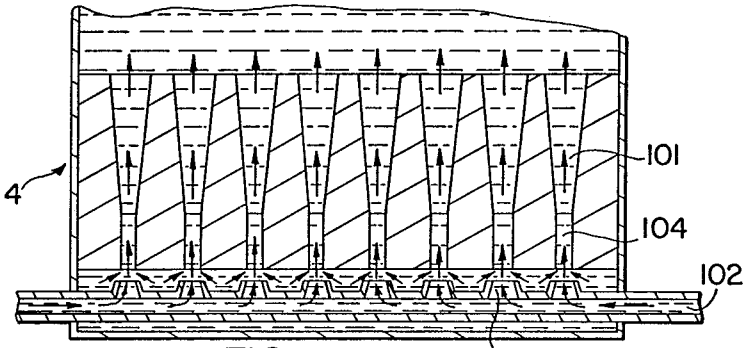
FIG. 4 is a section along the line C—C of FIG. 1, showing a row of liquid jet pumps for the ascending strip portion.

FIG. 4 is a vertical section along the line C—C of FIG. 1 showing one of the supply tubes (102) for electrolyte beginning at the connection to the circulation system outside the electroplating cell housing (4) with a row of eight round jet nozzles (103), attached to the supply tube, a row of eight round mixing tubes (104), a row of eight conic diffusors (101) connected to the mixing tubes.

The number of liquid jet pumps is an example. The number depends on the width of the plating cell and the width of the strip for which the cell is built.

The electroplating cell of the invention as shown in FIG. 1 works as follows:

The entering metal strip (1), which passes into the cell over the conductor roll (2) and moves vertically downwardly, runs as usual in the case of immersion type electroplating cells continually through a vertical processing run in a canal (6) midway between two rows of anodes (5), so that the descending strip portion (11) is electrolytically coated between the rows of anodes, to an immersion roll (3), which deflects the strip 180 degrees upwardly to a second conductor roll (2) which further directs the strip.

The strip which is deflected upwardly is thereafter further electrolytically coated on the strip portion (12) between the two rows of anodes (7) as it runs through the middle of the canal (8). The processing runs for the strip portions (11 and 12), the four rows of anodes (5, 7) as well as the immersion roll (3) are accomodated in a housing filled with electrolyte.

In order to achieve optimal coating conditions the electrolyte is circulated in the canals 6 and 7 against the direction of movement of the strip, that is in the region of the descending strip portion (11) from below toward above, and in the region of the ascending strip portion (12) from above toward below, with a speed of about 2 m/sec. As indicated by the illustrated arrows the circulation in the main takes place in four individual circuits in accordance with the arrows inside the cell. The drive of the liquid to maintain the circulation takes place by means of the jet pumping action of electrolyte which is delivered to the jet pumps from out of the overflow trap (43) through an external circulating system, which is not shown but which customarily consists of circulating pumps, filters, coolers and if necessary heaters, as well as circulating tubing, the electrolyte being delivered to the supply tubes (92, 102) and from there to the round jet nozzles (93, 103) of the jet pumps.

The electrolyte streams issuing from the round jet nozzles (93) suck in electolyte from the space between the housing wall (41) and the rear sides of the rows of anodes (11) and deliver it at increased speed to the mixing tubes (94) of the jet pumps, whose following diffusors (91), which convert the speed of the electrolyte stream in the mixing tube in part to pressure, deflect it 180 degrees to an upward direction.

The electrolyte stream from the slit shaped ends (95) of the diffusors is therefore delivered with sufficient speed and sufficient pressure into the slot between the descending portion (11) and the anode rows (5), so as to thereafter flow upwardly in the canal (6) against the direction of movement of the descending strip portion and toward the anode ends (51), according to the arrows of FIG. 1.

In the region of the anodes ends (51) the electrolyte stream passes through the intermediate spaces between the anode ends (51), as additionally illustrated in FIG. 2 and marked by the arrows. The electrolyte is deflected by the guide vane shaped formation of the upper housing wall end (45) in the space between the rear sides of the anode walls (5) and the housing (41) and from here is recirculated by the suction of the electrolyte streams from the round stream jets (93) of the jet pumps and is further circulated as indicated by the arrows.

The amount of electrolyte which is pumped into the cell through the round jet nozzles (93) increases the electrolyte volume in the cell and therefore excess electrolyte after its flow through the canal (6) and the anode ends (51) flows over the top wall end (45) into the overflow trap (43), from which it is redelivered to the round jet nozzles (93) of the jet pumps by the previously described external circulating system.

FIG. 3 illustrates the supply tube (92) with eight round jet nozzles (93) which is supplied with electrolyte by the circulating system installed outside of the cell. Below each of these round jet nozzles (93) is a mixing tube (94) with a following diffusor with a flat slit end (95) as illustrated so that the eight jet pumps form one unit which circulate the electrolyte over the entire width of the container without significant lateral deflection.

The number of eight jet pumps is to be taken as exemplary and is such as to suit the width of the plating cell which in turn is suited to the maximum width of the strips to be processed.

The two electrolyte circuits in the cell for the ascending strip portion (12) are similarly to be seen in FIG. 1 and are marked by arrows. The electrolyte stream issuing from the round jet nozzles (103) sucks additional electrolyte out of the extensive closed lower portion of the housing (4) of the electroplating cell, which electrolyte is delivered by these electrolyte streams into the round mixing tubes (104) and to the following round diffusors. In the mixing tubes (104) the speed of the electrolyte stream is increased and in the diffusors this speed is in part converted to pressure, so that in the lower part of the housing (4) a low pressure exists which creates a vertical electrolyte stream directed downwardly in the canal (8) between the anodes (7) on both sides of the ascending strip portion (12) with a desired speed of about 2 m/sec., which stream after leaving canal (8) is again sucked to the lower portion of the housing by the jet pumps for delivery to the mixing tubes (104). As shown by the arrows the liquid issuing from the diffusors flows in the direction of the arrows between the housing walls (42) and the rear sides of the rows of anodes (7) in the upper direction and is there deflected by the guide vane shaped bent housing wall top ends (46) and passes through the intermediate space between the anode ends (71)—these intermediate spaces are also illustrated in FIG. 2 and the flow therethrough indicated by arrows. The amount of electrolyte pumped through the round jet nozzles (103) into the mixing tubes by the external electrolyte circulating system increases the electrolyte volume in the cell and excess electrolyte therefore flows over the housing top ends (46) into the overflow trap (43), out of which it is then pumped by the external circulating system for re-supply to the supply tubes (102) and into the round jet nozzles (103).

FIG. 4 shows one of the two rows of eight jet pumps, each consisting of one jet nozzle (103), a mixing tube (104) and a diffusor (101), with the round jet nozzles (103) being arranged on a common supply tube (102) which is connected to the external circulating system for driving the jet pumps. The number of jet pumps—eight are illustrated and described—is selected according to the width of the container which in turn is suited to the maxiumum width of the strip to be processed. Therefore the flow to be produced is such that no substantial lateral deflection of the electrolyte stream appears and therewith there appears no difficulties with reference to the even distribution of the velocity.

The flow direction of the driving and the driven as well as the common electrolyte streams are similarily illustrated in FIG. 4 by arrows.

| LIST OF REFERENCE NUMERALS | |
|---|---|
| 1 | Metal strip to be processed |
| 11 | descending strip portion |
| 12 | ascending strip portion |
| 2, 21 | conductor roll |
| 3 | Immersion roll |
| 4 | electroplating cell housing |
| 41 | housing wall |
| 42 | housing wall |
| 43 | overflow trap |
| 45 | housing wall top end |
| 46 | housing wall top end |
| 5 | anode |
| 51 | anode end |
| 6 | canal |
| 7 | anode |
| 71 | anode end |
| 8 | canal |

-continued

| LIST OF REFERENCE NUMERALS | |
|---|---|
| | Liquid Jet Pump - consisting of: |
| 91 | diffusor |
| 92 | supply tube |
| 93 | round jet nozzle |
| 94 | mixing tube |
| 95 | flat slit orifice of diffusor |
| | Liquid Jet Pump - consisting of: |
| 101 | diffusor |
| 102 | supply tube |
| 103 | jet nozzle |
| 104 | mixing tube |

We claim:

1. A vertical electroplating cell with soluble anodes for depositing metal on metal strips in which the strip to be processed descends from an upper conductor roll to a lower deflecting immersion roll and from there is guided upwardly to a further upper conductor roll, and wherein the descending and ascending strip portions to be processed are each located in a canal between vertically arranged rows of soluble anodes and are encountered by an electrolyte flow of high velocity which moves in the direction opposite to the direction of strip movement, characterized in that inside of the electroplating cell housing there are means for producing four separate circulating flows of electrolyte such that in each of the canals (6, 8) receiving the strip portions (11, 12) the electrolyte flow is directed oppositely to the direction of movement of the strip, and which flows in the outer four flow canals between the rear sides of the anodes (5, 7) and the housing walls (41, 42) is driven by one row of jet pumps and redelivered to the canals between the strip and the anodes.

2. An electroplating cell according to claim 1 further characterized in that in each of the four electrolyte circulating flows several jet pumps are arranged whose driving jets (93, 103) are all connected to a single delivery tube (92, 102), which driving jets move the electrolyte flow into cylindrical mixing tubes (94, 104) followed by diffusors (91, 101).

3. An electroplating cell according to claim 1 further characterized that in the region of the descending strip run (11) within both of the outer flow canals which are formed between the housing wall (41) and the rear sides of the anodes (5) a downwardly directed electrolyte flow is created by a row of jet pumps, which flow is deflected by curved diffusors (91) with a slit shaped end opening (95) below the anodes and which flow is directed into the canal between the anodes and the strip (6) with an upwardly directed velocity component and which flow at the upper part of the anodes (5) moves through intermediate spaces between the anode ends (51) with the help of guide vane shaped upper edges of the housing wall (45) for redelivery to the jet pumps, and an overflow for the excess amount of electrolyte which excess electrolyte is redelivered to the driving jets (92) of the jet pumps by an external circulating system.

4. An electroplating cell according to claim 1 further characterized that in the region of the ascending strip run (12) within the two outer flow canals formed by the housing walls (42) and the rear sides of the anodes (7) an upwardly directed electrolyte flow is created by a row of jet pumps, which flow with the help of vane shaped formations on the upper edges of the container wall (46) moves through intermediate spaces between the upper ends of the anodes (71) and is delivered to the space above the canal between the ascending band run (12) and the anodes (7), after which the electrolyte flows through the canal (7) between the anodes and the strip downwardly into the lower portion of the housing of the electroplating cell under the influence a low pressure created in the lower portion of the housing by the jet pumps, and an overflow for the excess electrolyte formed by the upper edge of the container wall (46) which excess electrolyte is resupplied to the driving jets (92) of the jet pumps by an external circulating system.

5. An electroplating cell according to claim 2 further characterized that in the region of the descending strip run (11) within both of the outer flow canals which are formed between the housing wall (41) and the rear sides of the anodes (5) a downwardly directed electrolyte flow is created by a row of jet pumps, which flow is deflected by a curved diffusors (91) with a slit shaped end opening (95) below the anodes and which flow is directed into the canal between the anodes and the strip (6) with an upwardly directed velocity component and which flow at the upper part of the anodes (5) moves through intermediate spaces between the anode ends (51) with the help of guide vane shaped upper edges of the housing wall (45) for redelivery to the jet pumps, and an overflow for the excess amount of electrolyte which excess electrolyte is redelivered to the driving jets (92) of the jet pumps by an external circulating system.

6. An electroplating cell according to claim 2 further characterized that in the region of the ascending strip run (12) within the two outer flow canals formed by the housing walls (42) and the rear sides of the anodes (7) an upwardly directed electrolyte flow is created by a row of jet pumps, which flow with the help of vane shaped formations on the upper edges of the container wall (46) moves through intermediate spaces between the upper ends of the anodes (71) and is delivered to the space above the canal between the ascending band run (12) and the anodes (7), after which the electrolyte flows through the canal (7) between the anodes and the strip downwardly into the lower portion of the housing of the electroplating cell under the influence a low pressure created in the lower portion of the housing by the jet pumps, and an overflow for the excess electrolyte formed by the upper edge of the container wall (46) which excess electrolyte is resupplied to the driving jets (92) of the jet pumps by an external circulating system.

* * * * *